United States Patent [19]

O'Brien

[11] 3,962,803

[45] June 15, 1976

[54] DREDGING HEAD

[75] Inventor: Charles F. O'Brien, Golden Valley, Minn.

[73] Assignee: National Car Rental System, Inc., Minneapolis, Minn.

[22] Filed: Oct. 18, 1974

[21] Appl. No.: 515,992

[52] U.S. Cl. ..... 37/66; 37/43 E; 37/57; 37/189; 56/294; 198/217; 299/87

[51] Int. Cl.[2] ..... E02F 3/92; E02F 3/94; E02F 3/06; B65G 33/00

[58] Field of Search ..... 37/66, 65, 64, 67, 57, 37/189, 190, 81, 82, 43 E; 175/394; 299/87, 39; 408/224, 210, 211; 241/260.1, 246; 56/13.9, 294; 172/119, 532; 198/217, 213, 9; 302/15; 214/17 DB

[56] References Cited

UNITED STATES PATENTS

| | | | |
|---|---|---|---|
| 123,847 | 2/1872 | Spees | 175/394 X |
| 597,190 | 1/1898 | Reynolds | 37/57 X |
| 1,519,897 | 12/1924 | Asplund | 37/189 UX |
| 1,670,502 | 5/1928 | Gray | 37/189 UX |
| 1,790,789 | 2/1931 | Bosworth | 198/9 X |
| 2,311,865 | 2/1943 | Pilcher | 198/213 |
| 2,641,369 | 6/1953 | Mulcey et al. | 198/213 X |
| 2,717,742 | 9/1955 | Weigham et al. | 241/260.1 |
| 2,991,568 | 7/1961 | Smith | 37/66 |
| 3,054,247 | 9/1962 | Roesler | 56/294 X |
| 3,253,357 | 5/1966 | Allard | 37/65 |
| 3,521,387 | 7/1970 | Degelman | 37/66 |
| 3,738,029 | 6/1973 | Harmon | 37/66 |

FOREIGN PATENTS OR APPLICATIONS

| | | | |
|---|---|---|---|
| 43,830 | 12/1960 | Poland | 56/294 |

*Primary Examiner*—Edgar S. Burr
*Assistant Examiner*—Steven A. Bratlie
*Attorney, Agent, or Firm*—Schroeder Siegfried Ryan & Vidas

[57] ABSTRACT

A dredging apparatus having an improved dredging head in which the suction pump and drive motors for the same are mounted adjacent the clean-out and cutting augers for increased pumping efficiency. The augers include a cooperating plurality of cutting teeth mounted peripherally on the flighting of the auger and extending spirally along the same to provide for a continual shearing cutting surface in a line parallel to the rotational shaft of the augers for more efficient cutting of the fibrous materials.

8 Claims, 5 Drawing Figures

DREDGING HEAD

My invention relates to dredging apparatus and more particularly to an improved dredging head for use on a movable dredging apparatus utilized in removing material such as mud, silt, weeds, bog and the like from the bodies of water such as lake, marshes, and rivers.

Dredging equipment which perform this function is old and in use. At the present time, such equipment may take a variety of forms. The improved elements in the dredging head of the present invention are of the type shown in the patent to James D. Harmon, U.S. Pat. No. 3,738,029, entitled DREDGING HEAD WITH PIVOTALLY MOUNTED MUD SHIELD and dated June 12, 1973. The dredging head may be associated with a complete dredging apparatus such as is shown in the patent to N. V. Degelman, U.S. Pat. No. 3,521,387, entitled DREDGING MACHINE and dated July 21, 1970.

The present invention is directed to an improvement in the areas of the dredging head and suction pump which increases significantly the cutting capabilities of the dredging head to remove heavy material and fibrous material, such as boggy material, on the bottom of rivers and lakes and to effectively cut the same so that it may be directed with the water flow into the suction pump and removed from the bottom. The invention also incorporates an improvement in the suction pump in that it locates the pump on the dredging head and encloses the same to significantly increase the water flow and hence, the suction at the dredging head for more effective removal of solid materials. Therefore, in the present invention, the improved dredging head uses cooperating cutting knives which are mounted on the augers of the dredging head and on the frame of the head to more efficiently sever and direct the severed material along the edges of the augers and confine the same so that it may be directed to the intake associated with the pump. The improved pump is of the centrifugal type with its drive apparatus directly associated with the same and carried by the dredging head. The pump has its intake enclosed in a shroud with a flared opening at the head to effectively cover a large area of the head in solid material removal. The mounting of the motors directly at the pump significantly increases the power directed to the same, and cooperation of the increased suction and a mud shield for the dredging head significantly increases the water flow around the augers of the dredging head and into the intake of the dredging head to more effectively remove severed and solid materials from the bottom of the body of water.

Therefore, it is the principle object of this invention to provide an improved dredging head for a movable dredging apparatus.

Another object of this invention is to provide in an improved dredging head an improved cutting blade arrangement which incorporates knives to provide a better shearing action for the material and which knives are replaceable.

A still further object of this invention is to provide in a dredging head a mounting of a suction motor on the dredging head and adjacent the take-out augers for significantly increasing the suction and water flow into the dredging head for more effective material removal.

These and other objects of the invention will become apparent from the reading of the attached description together with the drawings wherein.

Figure 1:
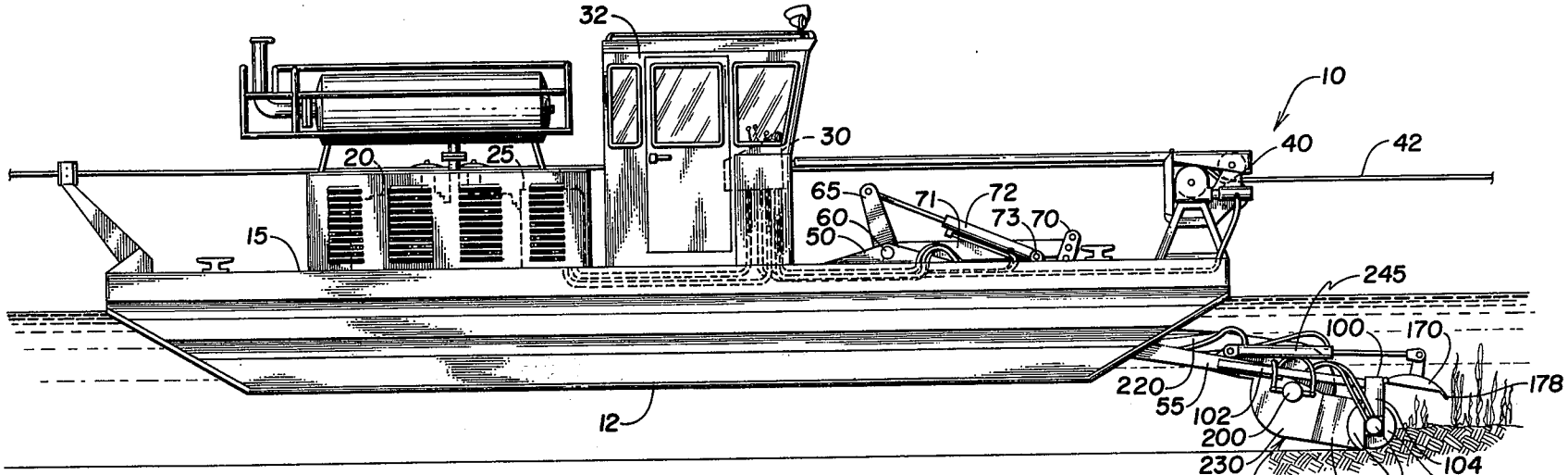
FIG. 1 is a side elevation view of the dredging apparatus of the improved dredging head showing the dredging head moving along the bottom of a body of water to clear the same.
Figure 5:
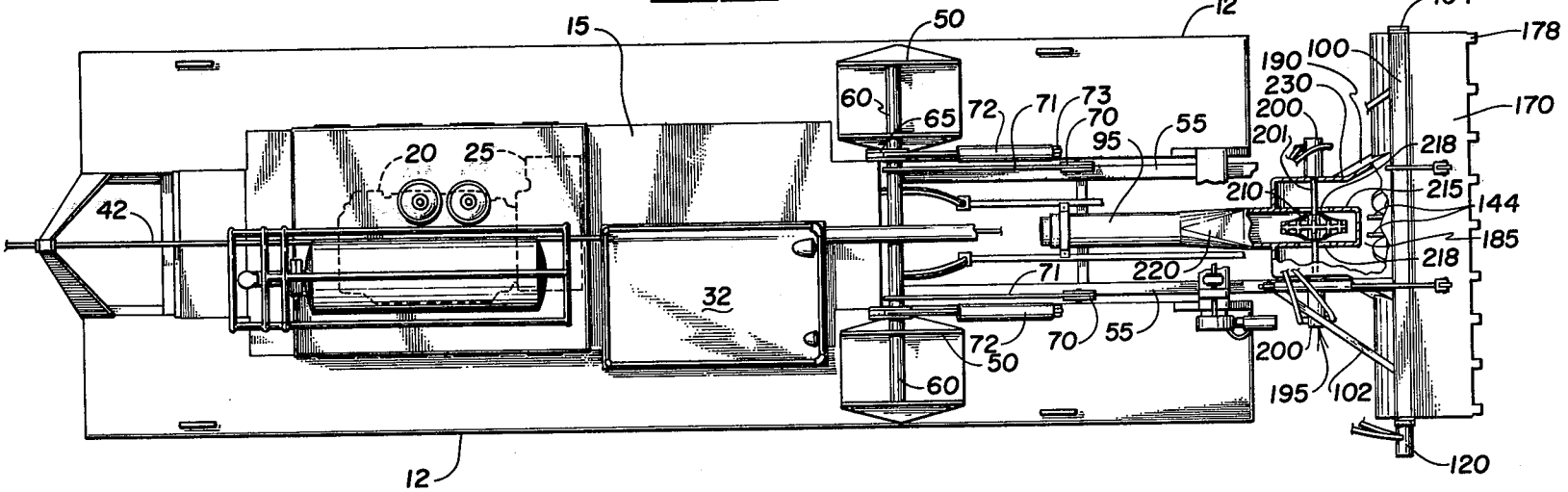

In FIGS. 1 and 5, the dredging apparatus is shown generally at 10 as incorporating float members 12 on either side of the central hull portion 15 which houses a drive motor 20 for an hydraulic pumping system, indicated at 25, and a control console 30 and cab 32. The cab and console provides a station for the operator with the controls for operating the various motors of the dredging apparatus, as will be hereinafter defined. The engine 20 through its hydraulic system operates the hydraulic capstan 40 which winds cabling 42 through guides on the pontoons and leading to remote anchoring points on either side of the body of water for moving the dredging apparatus within the body of water. Flange members 50 positioned on the forward end of the hull pivotally mount a pair of boom arms 55 positioned between the pontoons and extending beyond the forward ends of the same. The boom arms 55 are pivotally mounted on a shaft 60 which in turn is journaled on flange 50 to pivot the same on the dredging apparatus. Suitable adjustable linkage members 70, 71, connected between the boom arms 55 and the shaft 60 adjust the position of the boom arms 55 relative to the dredging apparatus. A pair of hydraulic actuators 72 are positioned between the hull and linkages 65 on either side of the arms 55 to raise and lower the boom arms or the boom relative to the dredging apparatus formed by the floats 12 and the hull 15 between transport and dredging position with the linkages adjusting the level of the dredging head beneath the surface of the water. A dredging head 90 is mounted on the free ends of the boom arms 55 and a suitable suction pipe 95 extending from the dredging heads extends to the dredging apparatus and leads through flexible conduits (not shown) to associated floation equipment or barges by means of which the dredged material may be removed from the body of water in which the dredge is working.

Figure 2:
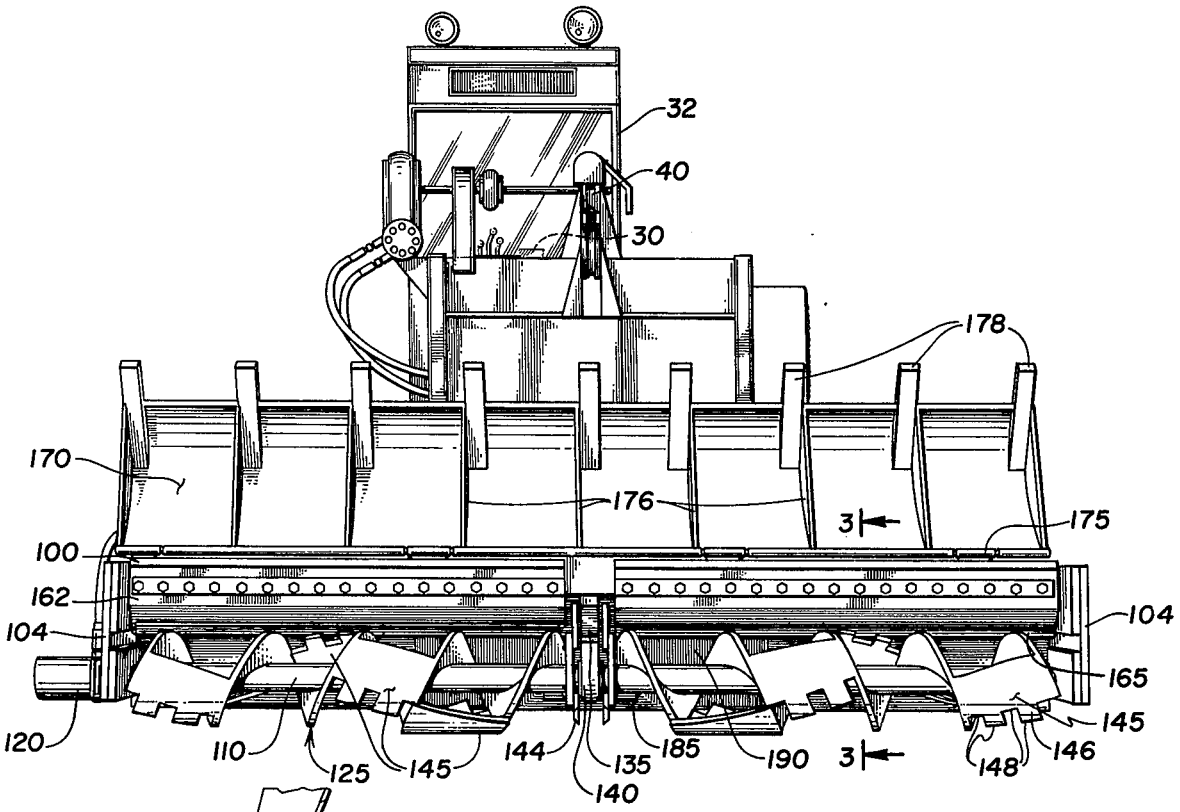
FIG. 2 is a front elevation view of the dredging head and lower boom of FIG. 1.
Figure 3:
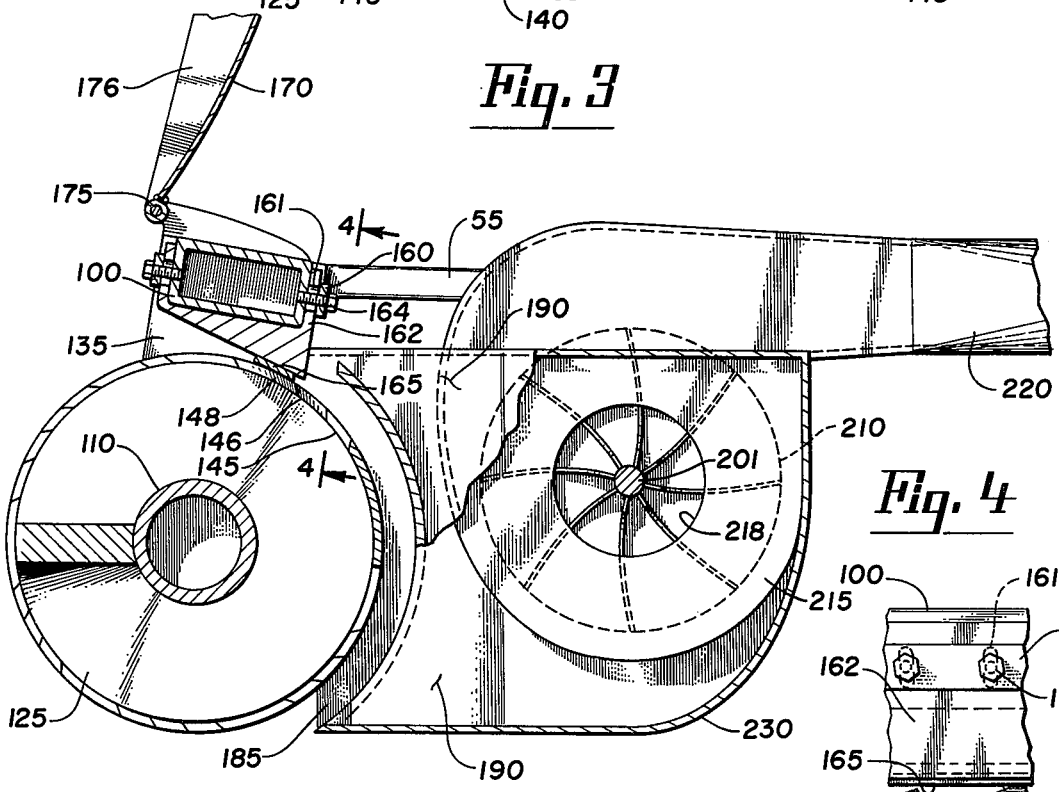
FIG. 3 is a sectional view of the dredging head of FIG. 2 taken along the lines 3—3 therein.

The dredging head 90, which will be best seen in FIGS. 2 and 3, is mounted on the boom arms 55. The head is comprised of a translationally extending frame 100 which is rigidly secured to the boom arms through cross bracing 102. The frame 100 includes downwardly extending side plates 104 positioned on each end of the frame which plates include bearings to journal a head shaft 110. The shaft is driven by a motor 120 mounted at one end of the shaft and on one of the side plates 104. The motor is of an hydraulic type and is reversable or bidirectional. Positioned on the shaft are a pair of spaced augers 125, 130, which are oppositely pitched so that the flighting directs material toward the center of the shaft between the augers where frame member 135 positioned on the frame 100 mounts a center bearing 140 journaling the center of the shaft 110. The auger sections extend from each of the side plates 104 to a position short of the central bearing 140 and suitable cutting knives 144 are positioned on the shaft at this point to cooperate with the frame member 135 as a cutting surface. The entire dredging head has a width substantially the same as the width of the dredging apparatus, or the floats and the hull, and the augers mount a plurality of cutting plates 145 which are connected on the peripheral edge of the auger flighting and are curved to conform to the circumference of the same. The individual plates 145 are spaced in a spiral manner along the extent of each of the spiral augers with each plate being positioned adjacent to similar plates on either side of the same to provide a spiral location of the plates 145 which extend around the circumference of the augers 125, 130, and spaced along the extent of the same similar to the positioning of the flighting of the augers. The plates are suitably secured to the peripheral edge of the flighting, such as by welding, and the plates which are generally rectangular in form are positioned normal to the flighting surface with the radius of the curvature concentric with the auger flighting and the shaft upon which the augers are mounted. The plates add circumferentially to the thickness of the auger, the thickness of the cutting plates, and each plate 145 has a pair of teeth 146 thereon which project from the body of the plate in direction of rotation of the shaft to define a toothed cutting surface. The teeth have beveled cutting surface 148, as does the spacing between the teeth and on all surfaces of the teeth 146 to provide for cutting surfaces extending across the entire face of each of the cutting plates. Each of the augers have similarly located cutting plates along the extent of the same so that as the auger is rotated, a cutting plate 145 on each auger is positioned adjacent to a cooperating cutting holder indicated at 162, which is mounted on frame 100 of the dredging head.

Figure 4:
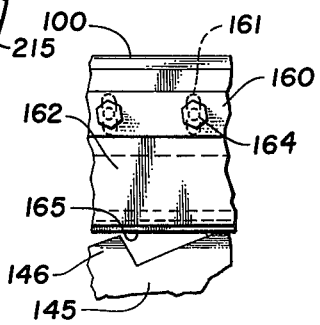
FIG. 4 is a sectional view of a portion of the cutting blade taken along the lines 4—4 of FIG. 3; and, FIG. 5 is a top elevation view of the dredging head with parts broken away showing the location of the pump and motors for the same.

As shown in FIGS. 3 and 4, the holders 162 are "U" shaped in form and are bolted along the extent of the frame 100. Adjacent each auger each of the holders is bolted to the frame 100, as indicated at 164, through the plates 160, along the extent of the same to provide a continuous holder each having a blade or cutting surface 165 welded at the end of the same. The holders are slotted at 161 to adjust the spacing between the cutting surfaces 165 and the plates 145. The blade or cutting toothed surface of the holders have a similar beveled edge of the teeth of the cutting plates 145 and the blades 165 on the holder cooperate with the entire surface of the cutting plate as the same is rotated past each of individual teeth making up the width of the cutting plate to provide a shear or scissors type action therebetween. The holders 162 have distributed along the extent of the same a continuous blade 165 with surfaces which cooperate with the cutting plates 145 on each of the augers adjacent the same as the auger is rotated. Any material in between will be severed and directed inwardly toward the shaft 110 of the auger to be moved with the auger rotation toward the center of the shaft of the dredging head.

Positioned over the augers is a shield 170 which is pivoted along the frame 100 above the holder as indicated at 175, such that the shield will overlay the augers. The shield has reinforcing plates 176 distributed along the extent of the same to reinforce the concave surfaces of the shield. At the outer edge of the shield is a plurality of projecting fender members 178 which prevent large objects from moving into the auger surfaces on the head. The shield provides a vaned concave surface to direct water flow and material flow around the auger and confines the material to the cutting surfaces of the auger permitting the same to be moved along the dredging head at the center of the same. With rotation of the shaft and augers, water flow will be directed around the surface of the auger conforming to the concave surface of the shield to improve water flow to the intake pipe of the dredging head. The intake pipe 185 of the dredging head has a flared extremity 190 which overlies the central portion of the augers or the spacing therebetween together with the journaling flange 135 of the shaft and the cutting knives 144 associated with the shaft at this point. The flared extremity continues parallel with and surrounding the rear side of the augers to insure that all material directed to the center of the auger will be directed into the intake pipe. Behind the intake pipe and mounted on the arms 55 of the boom is a suction pump 195, as seen in FIGS. 1 and 5, which is driven by a pair of motors 200 mounted on the ends of the drive shaft 201 of the pump. The motors 200 are of the hydraulic type and the pump, which may take various forms, is preferably a centrifugal type pump manufactured by the Crisafulli Pump Company of Glendive, Montana. It incorporates a double sided rotary impellor 210 mounted on the shaft 201 which extends through a casing 215 of the pump, the casing having inlet water and materials directed into the openings 218 will be directed by centrifugal action around the extent of the casing to the outlet pipe 220 where it will be discharged therefrom. The casing is mounted on the arms 55 of the boom and a shroud 230 encloses the same on the sides and the top and bottom thereof, with the sides flaring out to define the flared opening 190 at the intake end of the suction line or pipe 185 which surrounds the central portion of the auger. Beyond the shroud are mounted the motors 200 which are coupled to the shroud and hence, the boom arms to provide for rotation of the shaft 201 with the impellor of the pump thereon.

The location of the pump and motors on the boom arms adjacent the head, reduces the length of the hose coupling 95 which extends from the intake pipe 185 for the pump increasing the suction at the flared opening of the dredging head and significantly increasing the flow of water and material through the pump for improved efficiency in the dredging operation. Hydraulic fluid lines extend from the body of the dredging apparatus to the motors which are operated from a common supply line and through multiple control valves. Similarly, an actuator 245 is coupled between the dredging head and the shield 170 for tilting the same relative to the augers on the dredging head. Thus, hydraulic fluid is coupled through control valves from the hydraulic reservoir 25 in the hull 15 of the dredging apparatus and through the control console 30 and valves therein to the actuator motor 120 for driving the auger shaft, to the actuators 72 for elevating the boom and hence, positioning the dredging head with respect to the dredging apparatus, for the actuator 245 tilting the shield with respect to the augers on the dredging head, and for operating the motors 200 driving the pump 195 of the dredging head.

The improved dredging head for the dredging apparatus provides for more uniform speed and increased power to the head and in operation of the pumps to vary the flow of material therethrough. The improved cutting surfaces insure more positive cutting of the fibrous material on the bottom of the body of water, such as bog, and entrapment of the same in the augers to advance the same into the suction pump for removal from the body of water. With the improved apparatus, a more efficient dredging operation may be affected.

In considering this invention, it should be remembered that present disclosure is illustrative only and the scope of the invention should be determined by the appended claims.

What I claim is:

1. A dredging head adapted to be carried by a boom on one end of a movable pumping dredge to loosen and remove material from the bottom of a body of water comprising: an elongated frame including means for attachment to the boom and extending transversely thereof, a suction intake conduit attached to the elongated frame to transmit material into the dredge from the dredging head, a shaft positioned on the frame and including a drive motor mounted on one end of the shaft for rotating the same, a pair of augers having oppositely pitched flighting mounted on the shaft for directing material toward a spacing separating said augers on the shaft, said spacing between the augers positioned adjacent the intake conduit on the frame, a plurality of separate cutting blades being distributed circumferentially on the auger flighting in longitudinally spaced relationship with each blade being connected between adjacent peripheral edges of adjacent flighting to position the blades generally normal to the extent of the flighting to which they are attached, a blade mounting plate positioned on the frame adjacent the peripheral edges of the auger flighting and extending parallel to the shaft, removable cutting blades positioned on the blade mounting plate and distributed along the blade mounting plate to cooperate respectively with the cutting blades on the augers to sever material therebetween, and an adjustable elongated panel pivotally mounted on the frame and above the blade mounting plate having a generally concave under surface overlying the extent of the flighting on the augers to direct flow of water and material around the augers and to the suction intake conduit, said panel having projecting fender members thereon to prevent entrance of large objects into the augers, said plurality of separate cutting blades on each auger flighting each having a plurality of teeth projecting from an edge of the blade and in the direction of rotation of the augers.

2. The dredging head of claim 1 in which the elongated adjustable panel includes reinforcing ribs positioned along the concave under surface of the panel and in a direction normal to the elongated extent of the panel to strengthen the panel and improve water flow around the under concave surface of the panel.

3. The dredging head of claim 2 in which the plurality of separate cutting blades on the augers are coincedent with the plane of the peripheral edges of the adjacent flighting and are welded thereto with the blades having the teeth thereon being curved along their width to conform to the curvature of the flighting.

4. The dredging head of claim 1 in which the teeth on the edge of each cutting blade are spaced apart and the edge of the cutting blade and the spacing between the teeth all have beveled surfaces to provide a plurality of elongated cutting surfaces on each cutting blade and cooperating with the removable cutting blades positioned on the blade mounting plate.

5. The dredging head of claim 1 in which the plurality of cutting blades distributed on the spaced augers are positioned circumferentially along the flighting thereof with each cutting blade being disposed adjacent circumferentially of the cutting blades on either side thereof and with the cutting blades being so distributed circumferentially that a tooth on each of the pair of spaced augers simultaneously engages a cooperating removable cutting blade on the blade mounting plate at any one time.

6. The dredging head of claim 1 in which the intake conduit includes a suction pump carried by the elongated frame and movable with the frame on the boom.

7. The dredging head of claim 6 in which the intake conduit has a flared opening located adjacent the spacing between the pair of oppositely pitched augers with the suction pump located adjacent the flared opening.

8. The dredging head of claim 7 in which the suction pump has a shroud covering the intake conduit to the pump and coupling the flared opening of the intake conduit with the pump, and with motor means connected to the pump and outside of and on either side of the shroud.

* * * * *